US009475183B2

(12) United States Patent
Light

(10) Patent No.: US 9,475,183 B2
(45) Date of Patent: Oct. 25, 2016

(54) NON-ROTATABLE TELESCOPIC HANDLE CONSTRUCTION

(71) Applicant: I Gotcha Holdings, LLC, Winter Springs, FL (US)

(72) Inventor: Albert James Light, Winter Springs, FL (US)

(73) Assignee: Bag Boy, LLC, Richmond, VA (US)

( * ) Notice: Subject to any disclaimer, the term of this patent is extended or adjusted under 35 U.S.C. 154(b) by 95 days.

(21) Appl. No.: 14/160,085

(22) Filed: Jan. 21, 2014

(65) Prior Publication Data

US 2015/0202766 A1 Jul. 23, 2015

(51) Int. Cl.
*B25G 1/04* (2006.01)
*A63B 47/02* (2006.01)

(52) U.S. Cl.
CPC ..... *B25G 1/04* (2013.01); *A63B 47/02* (2013.01); *A63B 2102/32* (2015.10); *A63B 2225/093* (2013.01); *Y10T 16/473* (2015.01)

(58) Field of Classification Search
CPC . Y10T 16/4719; Y10T 16/473; A63B 47/02; A63B 2225/093; A63B 2102/32; B25G 1/04; E04H 12/182; F16B 7/105
USPC ..... 16/427, 429; 294/19.2; 15/144.4; 403/109.1–109.3
See application file for complete search history.

(56) References Cited

U.S. PATENT DOCUMENTS

| | | | | |
|---|---|---|---|---|
| 4,073,529 | A * | 2/1978 | Ostrin | A63B 47/02 294/19.2 |
| 4,325,157 | A * | 4/1982 | Balint | B05C 17/0205 15/144.4 |
| 4,659,125 | A | 4/1987 | Chuan | |
| 5,265,926 | A | 11/1993 | DiNardo | |
| 5,908,214 | A | 6/1999 | Dinardo | |
| 7,073,228 | B2 | 7/2006 | Light | |
| 7,168,128 | B2 * | 1/2007 | Evans | F16L 27/12 15/144.4 |
| 2011/0219907 | A1 * | 9/2011 | Rietzler | B29C 59/043 74/493 |

* cited by examiner

*Primary Examiner* — William Miller
(74) *Attorney, Agent, or Firm* — Troutman Sanders LLP; John A. Morrissett

(57) ABSTRACT

A golf ball retriever handle having a plurality of telescoping segments, each segment comprising a tubular member configured to fit relatively snugly about an adjacent member in sliding engagement therewith, each of the members between the smallest diameter member and the largest diameter member being formed with a radially extending annular rib in proximity to a first end thereof and being formed with a radially inward extending annular depression in proximity to a second end thereof, whereby separation of the tubular members in a handle extending direction is inhibited. The handle also having at least one axial groove formed in each section such that overlapping grooves engage each other to prevent rotation of one section with respect to another.

20 Claims, 2 Drawing Sheets

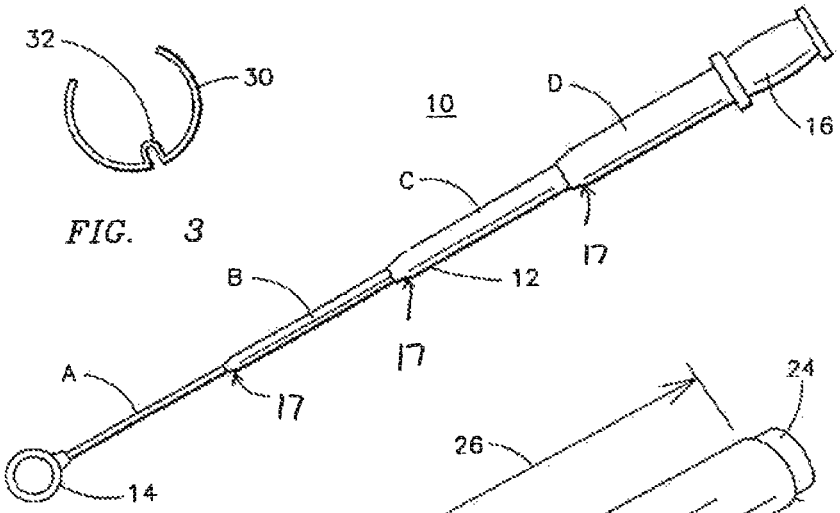
FIG. 3
FIG. 1
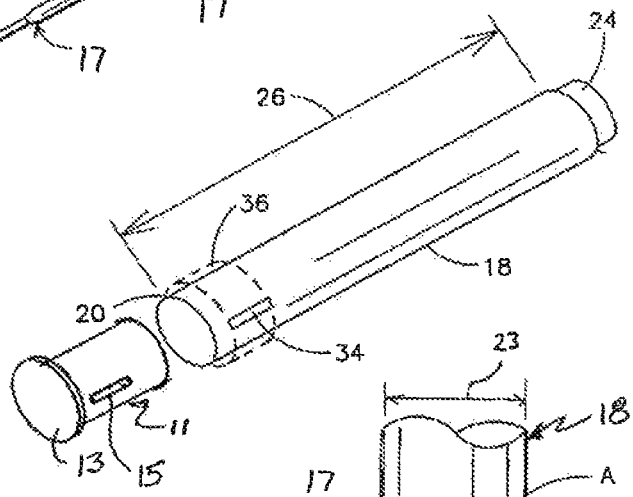
FIG. 2
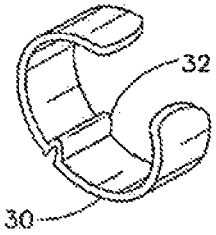
FIG. 4
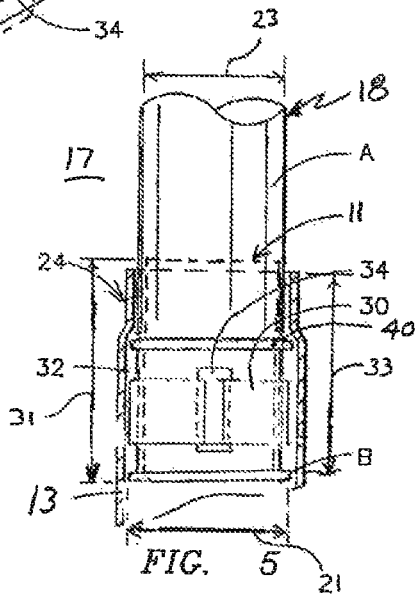
FIG. 5

NON-ROTATABLE TELESCOPIC HANDLE CONSTRUCTION

FIELD OF THE INVENTION

The present invention relates to telescoping handles for various implements such as, for example, golf ball retrievers.

BACKGROUND OF THE INVENTION

Golf ball retrievers are well known devices generally constructed of a telescoping handle with a ball trapping or pick-up element attached to an end of the ultimate section of the handle. An exemplary form of such a retriever is shown in U.S. Pat. No. 5,265,926 of Frank L. DiNardo. The telescopic handle of such retrievers is formed of a plurality of sections and may be extendable from a collapsed length of about 3 feet to an extended length of about 18 feet. However, there are also other retrievers which may have a collapsed length of about 1 foot and extend to about 8 feet. Obviously, a 1 foot retriever extending to 8 feet requires at least eight telescoping sections.

The larger retrievers, i.e., those having an initial length of about 3 feet, generally use large diameter tubing, e.g., about 1 inch O.D. in the largest handle section, which allows use of various types of camming devices for locking the handle in any position. An exemplary form of handle structure using cam type locking devices is shown in U.S. Pat. No. 4,659,125.

While the camming structure is appropriate for larger retrievers, the smaller retrievers are generally constructed with a largest section having an outer diameter of no more than about 0.5 inch and the smallest section having an outer diameter of at least about 0.25 inch. Cam locking structures are difficult to implement in the smaller retrievers due to this reduced diameter.

Another form of handle assembly which is more practical for the smaller handles is one which relies solely on frictional engagement between the telescoping sections and does not use a positive type lock for holding the sections in a fixed position. One particular design forms each handle section with a uniform diameter except for a relatively short necked down (reduced diameter) portion at one end of each section. A pair of diametrically opposite small holes are formed at an opposite end of each section. Each inner section has an outer diameter that is less than an inner diameter of each immediately overlaying section by twice the thickness of one of a pair of bronze shims placed between the sections. Each of the shims has a punched dimple which fits into a respective one of the holes formed in the section to capture the shims in a fixed position at one end of the section. The shims form a tight, sliding relationship between adjacent sections with the bronze material acting as a bearing. Since the reduced diameter end cannot pass over the shims, the original intent was to use the shims in a secondary function to attempt to prevent the sections from being pulled apart when the retriever handle is extended.

One problem with this small handle construction is that a golfer who has to use the retriever is often angry and will attempt to extend the telescopic handle with unnecessary force. As a result, the small dimple can shear away and allow the sections to separate and destroy the retriever. This problem is exacerbated in better quality retrievers made from thin wall, stainless steel tubing since the thin wall has a near knife edge and easily shears the bronze shim material.

U.S. Pat. No. 5,908,214 discloses a further improvement in handle construction in which the pair of bronze shims are replaced by a unitary bronze sleeve extending about three quarters of the way around an end area of each telescoping tube forming the extendable handle. In the '214 patent, the shims become a one piece partial sleeve sized to fit snugly about a respective one of the telescoping tubes and having a crimped portion extending radially inward over an axial extent of the sleeve intermediate its opposite circumferential ends. Each tube has an axially extending slot adjacent a first end for receiving the crimped portion of the sleeve when the sleeve is positioned on the tube. The handle is assembled by sliding another tube over the tube and sleeve. The overlaying tube has one end terminating in a necked down portion having an inner diameter larger than an outer diameter of the inner tube and smaller than a diameter of the sleeve when the sleeve is positioned on the inner tube whereby the one end of the outer tube normally cannot pass over the sleeve on the inner tube. Unfortunately, there are occasions in which the user of the handle will jerk the extensions so hard that the shim is distorted and the smaller diameter tube will slip over the shim and cause the tubes to separate. Accordingly, it is desirable to provide an additional feature to further inhibit the tubes from separating.

U.S. Pat. No. 7,073,228, assigned to the assignee of the present invention, describes and claims a further improvement to the handle construction of the aforementioned '214 patent. As explained in the '228 patent, when the handle is extended, the weight of the several extending tubes causes the handle to deflect to a relatively large extent making the handle difficult to accurately position and put pressure on an object at the distal end of the handle. The '228 patent provides an improvement to the handle by incorporating a short stiffener at each joint of the tubes. Each of the stiffeners has an outside diameter sized to fit snugly within an inside diameter of an associated tube and is positioned in an end of the associated tube remaining within an adjacent larger diameter tube when the handle is extended. Each stiffener has an axial length at least as long as an overlap length of the associated tube and the adjacent larger diameter tube when the handle is extended. Preferrably, the stiffener includes a cap having an outside diameter substantially the same as the associated tube outside diameter to prevent the stiffener from slipping further into the end of the associated tube. Notwithstanding the greater flex strength added by the stiffeners, it is further desirable to provide a construction that will further increase the flex strength of the extended handle. It is also noted that there are instances in which the tool attached to the end of the handle can be rotated by pressure applied to the tool. For example, in the case of a golf ball retriever using a form of cup at the end of the handle for grasping a golf ball, the friction fit between each of the tube sections may allow the tubes to rotate with respect to each other such that any resistance at the retriever cup may allow it to rotate and inhibit the ability to retrieve the golf ball. Such rotation is not an issue with the longer retrievers that use a cam locking device as is described in the aforementioned '125 patent. However, with the shorter retrievers that only rely on friction fit, rotation becomes an issue.

SUMMARY OF THE INVENTION

Among the several objects of the present invention may be noted the provision of an improved telescoping handle assembly; the provision of a telescoping handle assembly which has better resistance to separation; and the provision of a telescoping handle assembly that resists rotation of the telescoping sections. The above and other objects, features and advantages will be in part apparent and in part pointed out in the description to follow. In an illustrative embodiment, the telescoping handle of the present invention is formed of a plurality of telescoping sections or tubes with each section having an outer diameter which is slightly smaller than an inner diameter of an immediately overlaying section. Each section has one end formed with a necked down portion having an inner diameter which slides in abutting relationship on the outer surface of an immediately underlying section. An opposite end of each section is formed with a single axially extending closed end slot. A bronze sleeve fits around the section and has a radially inward directed tab portion extending over the axial extent of the sleeve. The tab portion is sized to fit the slot. In a preferred form, the tab portion is formed by bends in the sleeve and the sleeve is sized to fit about 270 degrees around the handle section. The sleeve can be positioned on the handle and will stay in place without being held. During assembly, the sleeve can be pressed against the section surface to allow another section to be slid over the sleeve.

Immediately above each sleeve, each handle section is formed with an annular ridge extending radially outward to a distance slightly greater than the thickness of the sleeve. An opposite end of each handle section is formed with an annular ridge extending inward to a distance substantially equal to the height of the outwardly extending annular ridge. Each handle section is sized in diameter such that the inwardly extending annular ridge is in sliding contact with an immediately smaller diameter handle section while the outwardly extending annular ridge is in sliding contact with the next largest diameter handle section. Accordingly, each handle section is in sliding contact at a point adjacent each end of each handle section. In addition, the bronze sleeve of each handle section is in sliding contact with an immediately larger diameter handle section. When the handle sections are extended, the inwardly extending and outwardly extending annular ridges of adjacent sections abut against each other to prevent the handle sections from separating.

In another form, each of the handle sections is formed with an axially extending groove at at least one circumferential location although, in a preferred form, two axial grooves are formed at 180 degree displacement around the handle section. The grooves are arranged and sized so that the handle sections slide together with a groove in one section fitting into a groove in each overlapping section. This interlocking of the grooves prevents the sections from independently twisting thereby maintaining the position of the head of the ball retriever. In addition, the grooves add strength to the handle thereby reducing the amount of flex in the handle when extended.

BRIEF DESCRIPTION OF THE DRAWINGS

For a better understanding of the present invention, reference may be had to the following detailed description taken in conjunction with the accompanying drawings in which:

FIG. 1 is simplified view of a golf ball retriever with which the present invention may be used;

FIG. 2 is a perspective view of one tubular section of the retriever of FIG. 1;

FIG. 3 is an end view of a sleeve used in the assembly of the handle of FIG. 1;

FIG. 4 is a perspective view of the sleeve of FIG. 3;

FIG. 5 is a partial cross-sectional view of a tube connection joint incorporating the prior art of FIGS. 2-4 and one aspect of the present invention;

DETAILED DESCRIPTION OF THE INVENTION

Figure 6:
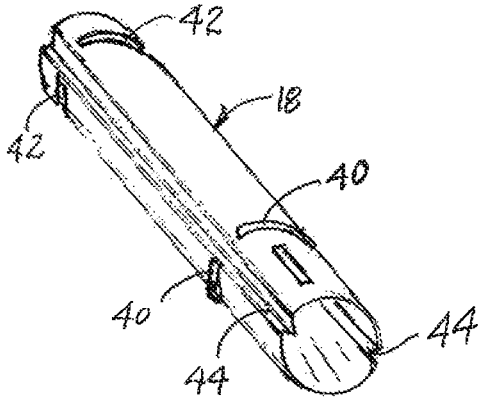
FIG. 6 is a perspective view of one tubular section formed in accordance the present invention.

Applicant has found that telescoping handles, when positioned in an extended state, could be made stiffer and avoid many of the bending problems associated with prior telescoping handles using a small stiffener, or plug, at the juncture of each joint of the retriever. The details of such a handle is shown and described in U.S. Pat. No. 7,073,228, the disclosure of which is hereby incorporated by reference. The present invention is an improvement over the invention of the '228 patent to further enhance stiffness of the extended telescoping handle and to reduce the chance of separation of the individuals segments of the handle.

Turning now to the drawings in general and in particular to FIGS. 1, 3 and 4, the invention will now be described in the context of a golf ball retriever having a handle 12 and grip 16 and comprising a plurality of telescoping segments or tubes 18, each of which has a sequentially smaller diameter and sequentially shorter length, and a ball grabbing head 14. The diameter of each tube may be about 0.85 inch for the outermost tube 18 (D in FIG. 1) and about 0.25 inch for the innermost tube 18 (A in FIG. 1). The tube 18 lengths 26 may vary from about 24 inches to about 12 inches as a function of overall extended length of handle 12. For example, an 18 foot (extended length) handle may have 13 sections. Since each section may have less than one inch of overlap, the longer handle tends to exhibit substantial flexing. Accordingly, referring to FIGS. 2 and 5 of the '214 patent, it can be seen that the handle 12 is modified by incorporating a stiffener, or a plug 11, which extends into an end portion of each section or tube 18 of the golf ball retriever handle. The plug 11 is positioned in an end 20 of the associated tube 18, such as tube A, remaining within an adjacent larger diameter tube, such as tube B, when extended, for example, as shown in FIG. 1. Each of the plugs 11 has an outside diameter which fits snugly within the inside diameter of the associated tube 18. As shown in FIG. 5, the length 31 of the plug 11 is at least as long as, and may be greater than, an overlap length 33 of the associated tube A and the adjacent larger diameter tube B when in the extended state. In a preferred embodiment, the plug 11 has a length of about 1.25 inches. However, different length plugs 11 may be used at the different intersections depending on the diameter of the handle section or tube 18.

The plug 11 may further include a cap 13 which has an outside diameter 21 that is approximately the same as the outside diameter 23 of the associated tube 18 so that the plug 11 fits into the tube 18 but is stopped from slipping further into the tube 18 by means of the edges of the cap 13 contacting the edges of the tube 18 at the end 20 when the plug 11 is inserted into the tube 18. FIG. 5 shows how the cap 13 has a diameter 21 sufficient to prevent the plug 11 from penetrating or slipping into the tube 18.

Each plug 11 is also provided with a small slot 15 for receiving the bent element 32, or crimped portion, in each of the associated sleeves, or C-clips 30. The slot 15 is necessary to allow the element 32 to penetrate through the slot 34 in the tube 18 so that the C-clip 30 is not able to move with respect to the tube 18 once the multiple tubes have been assembled into a single telescoping handle 12 as shown in FIG. 1. The C-clips are preferably brass members that extend the diameter of the smaller tube A and cooperate with the necked down portion 24 of tube B so that the smaller tube will not slide out of the larger tube.

Preferably, the plug 11 is formed from a polymer, such as plastic or nylon. The material of the plug 11 is not critical but should be of a type that will provide rigidity so that the plug 11 itself cannot be deformed. What applicant has found is that by using a short plug 11 at each joint 17, the handle 12 acquires a high degree of stiffness and can be constructed in the same manner as the telescoping handle in the '214 patent but with a much longer length. For example, it is possible to construct the telescoping handle 12 at lengths of about 18 feet with minimal bending or flexing of the handle 12 using the short plug insert 11 at each overlapping joint of the tubes 18.

The present invention improves on the handle 10 disclosed in the '228 patent by providing additional means to strengthen the handle and for preventing separation of the segments of the handle. Referring to FIGS. 5 and 6, each of the handle segments or tubes 18 are formed with a radially outward extending annular rib 40 having an outer diameter that is slightly greater than the combination of the brass C-clip and associated tube but still slides within the next larger tube. In FIG. 5, the rib 40 will abut against the necked down portion 24 to prevent tube separation. An alternate tube construction is shown in FIG. 6 in which the end of a tube opposite the end having the rib 40 is formed with an annular depression or reduced diameter rib 42. In this embodiment, the necked down portion 24 may be shortened to just a rolled end with the interference between the raised rib 40 and the depressed rib 42 serving to prevent separation of overlapping tubes.

Figure 7:
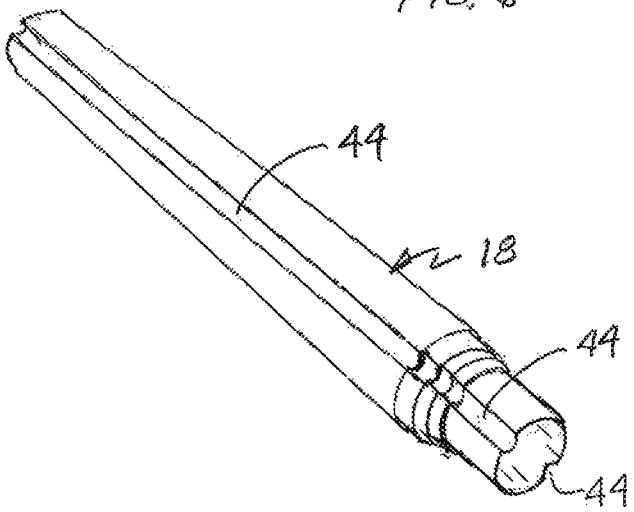
FIG. 7 is a perspective view of a plurality of the tubular sections of FIG. 6 arranged in a telescoping assembly useful in creating a handle.

FIG. 6 also shows the axially extending depressions or grooves 44 on opposites side of a tube. Each tube is formed with such grooves that are aligned in the form shown in FIG. 7. As a result of the engagement of the grooves 44, the individual tubes 18 are not able to freely rotate with respect to each other. This arrangement constrains the orientation of the retriever head 14 to make it easier for the user of the retriever to position the head for grabbing a ball at a distance. In addition, the axial grooves 44 yields further bending strength to the handle so that it is capable of reaching greater distances with less downward deflection.

While various embodiments of the present invention have been shown and described herein, it will be obvious that such embodiments are provided by way of example only. Numerous variations, changes and substitutions will occur to those of skill in the art without departing from the invention herein. For example, the invention may used in any telescoping rod configuration where increased rigidity is needed. Accordingly, it is intended that the invention be limited only by the spirit and scope of the appended claims.

What is claimed is:

1. A golf ball retriever handle having a plurality of telescoping segments, each segment comprising a tubular member configured to fit relatively snugly about an adjacent member in sliding engagement therewith, each of the members between a smallest diameter member and a largest diameter member of the tubular members being integrally formed with a radially extending annular rib and a side aperture both in proximity to a first end thereof and being formed with a necked down portion in proximity to a second end thereof, a diameter of the necked down portion being smaller than a diameter of the annular rib, wherein the annular rib is configured to abut the necked down portion when the handle is extended to prevent separation of the tubular members, and the annular rib is inwardly positioned relative to and spaced from the side aperture.

2. The golf ball retriever handle of claim 1 further comprising at least one axially extending groove formed along at least a portion of each of the tubular members, the grooves being exposed on inner and outer surfaces of each tubular member and sized and configured to intermesh in the assembled handle to limit rotation of one tubular member with respect to another.

3. The golf ball retriever handle of claim 2, wherein the at least one groove comprises a pair of axially extending grooves formed opposite one another along an entire length of each member.

4. The golf ball retriever handle of claim 2, wherein the annular rib is obstructed by the at least one axially extending groove.

5. The golf ball retriever handle of claim 2, wherein each of the members between the smallest diameter member and the largest diameter member of the tubular members is formed with a radially inward extending annular depression in proximity to the second end thereof.

6. The golf ball retriever handle of claim 5, wherein the annular depression is obstructed by the axially extending groove.

7. A golf ball retriever handle having a plurality of telescoping segments, each segment comprising a tubular member configured to fit relatively snugly about an adjacent member in sliding engagement therewith, each of the members being formed with at least one axially extending groove formed along at least a portion of each tubular member, the at least one groove being exposed on inner and outer surfaces of each tubular member and sized and configured to intermesh in the assembled handle to inhibit rotation of one tubular member with respect to another, wherein each of the members between the smallest diameter member and the largest diameter member is integrally formed with a radially outward extending annular rib proximate a first end thereof, and the annular rib is obstructed by the at least one groove.

8. The golf ball retriever handle of claim 7 wherein each of the members between the smallest diameter member and the largest diameter member is formed with a radially inward extending annular depression in proximity to a second end thereof, whereby separation of the tubular members in a handle extending direction is inhibited by interaction between the inward extending depression and the outward extending rib.

9. The golf ball retriever handle of claim 8 wherein the annular depression is obstructed by the at least one axially extending groove.

10. The golf ball retriever handle of claim 7, wherein the at least one groove comprises two opposing axially extending grooves, and the annular rib is obstructed by the axially extending grooves.

11. The golf ball retriever handle of claim 7, wherein the at least one groove extends an entire length of each tubular member.

12. A telescoping golf ball retriever handle comprising:

a hollow first tube comprising first and second ends and at least one side, the at least one side of the first tube having one or more apertures and a radially extending annular rib proximate the second end;

a hollow second tube comprising first and second ends and at least one side having a necked down portion proximate the first end, the necked down portion having an inner diameter larger than an outer diameter of the second end of the first tube, wherein the second tube is configured to slidably fit about the first tube such that the first end of the second tube overlaps at least the second end of the first tube; and a partial sleeve configured to fit snugly about the first tube, the sleeve having a crimped portion extending radially inward, wherein one of the apertures of the first tube is configured to receive the crimped portion when the sleeve is positioned about the first tube, wherein the inner diameter of the necked down portion is smaller than an outer diameter of the annular rib, and the annular rib is configured to abut the necked down portion to inhibit separation of the first tube from the second tube when the handle is extended.

13. The golf ball retriever handle of claim 12, wherein the crimped portion of the sleeve extends radially inward over an axial extent of the sleeve intermediate opposite circumferential ends of the sleeve.

14. The golf ball retriever handle of claim 13, wherein at least one of the apertures comprises an axially extending first slot, the first slot having axial and circumferential dimensions corresponding to the crimped portion of the sleeve for receiving the crimped portion when the sleeve is positioned on the first tube.

15. The golf ball retriever handle of claim 12 further comprising a stiffener having an outside diameter configured to fit snugly within an inside diameter of the second end of the first tube, the stiffener being configured to remain within the second end of the first tube and the first end of the second tube when the handle is extended.

16. The golf ball retriever handle of claim 15, wherein the stiffener has an axial length at least as long as an overlap length of the first and second tubes when the handle is extended.

17. The golf ball retriever handle of claim 12 further comprising at least one axially extending groove formed in the tubes, wherein the first tube is insertable into the second tube to form the handle with the grooves interlocking to prevent rotation of the first tube relative to the second tube.

18. The golf ball retriever handle of claim 17, wherein the at least one groove comprises a pair of axially extending grooves formed opposite one another on the at least one side of each of the tubes.

19. The golf ball retriever handle of claim 12, wherein the inner diameter of the necked down portion is smaller than an outer diameter of the sleeve when the sleeve is positioned on the first tube, and the sleeve is configured to inhibit separation of the first tube from the second tube when the handle is extended.

20. The golf ball retriever handle of claim 12, wherein the necked down portion of the second tube comprises an annular depression.

* * * * *